US005731759A

United States Patent [19]

Finucan

[11] Patent Number: 5,731,759

[45] Date of Patent: Mar. 24, 1998

[54] COMBINATION FLASHLIGHT, SMOKE DETECTOR AND EMERGENCY ALARM

[76] Inventor: Timothy R. Finucan, 24417 Leafwood Dr., Murrieta, Calif. 92562

[21] Appl. No.: 512,120

[22] Filed: Aug. 7, 1995

[51] Int. Cl.[6] ..... G08B 17/10

[52] U.S. Cl. ..... 340/628; 340/574; 340/693

[58] Field of Search ..... 340/628, 632, 340/641, 573, 574, 693

[56] References Cited

U.S. PATENT DOCUMENTS

| | | | |
|---|---|---|---|
| 4,617,561 | 10/1986 | Brown | 340/628 |
| 4,821,026 | 4/1989 | Newsom | 340/693 |
| 4,949,077 | 8/1990 | Mbuthia | 340/628 |
| 4,959,637 | 9/1990 | Woods et al. | 340/693 |
| 5,146,209 | 9/1992 | Beghelli | 340/628 |
| 5,309,145 | 5/1994 | Branch et al. | 340/628 |
| 5,422,629 | 6/1995 | Minnis | 340/628 |
| 5,442,336 | 8/1995 | Murphy et al. | 340/628 |

*Primary Examiner*—Jeffery Hofsass
*Assistant Examiner*—Timothy Edwards, Jr.
*Attorney, Agent, or Firm*—John R. Duncan; Frank D. Gilliam

[57] ABSTRACT

A combined flashlight, smoke detector and emergency alarm assembly. A housing contains a flashlight having a bulb, reflector and window at one housing surface for illuminating an area adjacent to the assembly. A smoke detector is enclosed by said housing and includes an alarm for indicating the presence of smoke. A relay automatically turns the flashlight on when the alarm is activated. Vents in the housing permit ingress of smoke to the detector. A battery assembly in the housing provides power for the flashlight, smoke detector and alarm. A manually operable, momentary, normally closed, switch is provide to permit the alarm to be disabled, with the alarm enabled if this switch is released. Another switch is provided to enable the alarm independent of the smoke detector system as an emergency alarm. A manual flashlight switch is further provided to permit the flashlight to be used in a normal manner in a non-alarm situation. The battery assembly includes plural battery cells providing a higher voltage to the smoke alarm and having a tap to provide a relatively lower voltage to the flashlight.

8 Claims, 1 Drawing Sheet

COMBINATION FLASHLIGHT, SMOKE DETECTOR AND EMERGENCY ALARM

BACKGROUND OF THE INVENTION

This invention relates in general to emergency equipment and, more specifically to a device which incorporates a flashlight and smoke detector/alarm powered by a single battery power source and a manually actuated alarm.

Smoke detectors that detect the products of combustion and sound an alarm when a concentration threshold is exceeded are coming into widespread use. Since most are powered by batteries or house current and permanently placed in rooms, recreational vehicles and the like, each room to be fully protected must include a separate detector. Portable smoke detectors are available for use in rooms without a permanent detector. The portable smoke detectors can be conveniently taken along when traveling or working in an unprotected room. When the alarm sounds, the person immediately evacuates the building.

While smoke detectors are very effective where the source of combustion is near the detector, where a fire is located some distance away and considerable smoke is generated in the general area, leaving a room and exiting the building may be very difficult because of reduced visibility. Flashlights have been mounted on a smoke detector in a manner such that when the detector alarm sounds, the flashlight can be removed and used to aid in exiting the area. Typical of these arrangements is that described by Vrown in U.S. Pat. No. 4,617,561. Others have fastened an independently powered smoke detector to a conventional flashlight, such as is described by Kichline in U.S. Pat. No. 4,862,148, providing both and alarm and a light source to guide a person through darkness or smoke.

Combinations detectors for other dangerous gases have been combined with sources, such as the helmet mounted gas detector and light described by Gautier in U.S. Pat. No. 4,263,588 for use in mines. A flashlight for use by police which includes a detector for alcohol on a driver's breath is disclosed by Yokoyama et al. in U.S. Pat. No. 4,617,821.

While each of these is effective in detecting smoke or gas, sounding an alarm and providing a light source, problems remain in using them in emergency, especially smokey, situations.

Generally it is desirable that the smoke detector alarm be turned off while a person is exiting a smokey area with the aid of the light, so that the person can hear calls or directions from emergency personnel. But if the person should lose consciousness, the emergency personnel will have difficulty finding him or her in a dark, multi-room building or the like.

If the person should happen to caught by falling debris in an earthquake, tornado, explosion or other disaster where fire and smoke have not yet begun, a simple smoke alarm flashlight will be of little use in alerting emergency personnel to the location of the trapped person.

Thus, while the prior combination flashlight and smoke detector alarms are extremely helpful under limited circumstances, they do not provide protection under other conditions such as where a person looses consciousness while exiting a fire area, becomes trapped in a non-fire area, etc.

SUMMARY OF THE INVENTION

The above-noted problems, and others, are overcome in accordance with this invention by a combined flashlight, smoke detector and emergency alarm assembly which basically comprises a flashlight having a bulb and reflector for illuminating an area, a smoke detector, an audible alarm for indicating the presence of smoke, a battery for powering the flashlight, detector and alarm, and a relay to turn on the flashlight when the alarm is actuated.

A manually operable, momentary, normally closed, switch is preferably provided to disable the alarm while the switch is continuously operated. A manual on-off switch is preferably included so that the flashlight can be used as a normal flashlight when the smoke detector and alarm are not actuated. Also, a switch may be provided to enable the alarm to be turned on independent of the smoke detector system as an emergency alarm.

While any suitable battery system may be used to power the flashlight, detector and alarm, preferably a single battery system is used, providing higher voltage power to the detector and alarm and tapped to provide a lower voltage to the flashlight bulb. Typically, nine volts produced by six 1.5 volt cells is supplied to the detector and alarm, with the battery pack tapped between the fourth and fifth cell to provide six volts to the flashlight bulb.

The device may be placed in any room, carried in any vehicle such as a motor home or the like, taken on trips and used in hotel rooms, etc. In the event of a fire, the smoke detector alarm will sound and the flashlight will turn on, allowing a person (even if deaf) to easily find the device in a dark or smokey environment. A person can then use the flashlight to light the way out of the area. The device may be kept near an exit, illuminating the exit, to aid in escaping. Pressing the momentary switch and holding it in the open position will quiet the alarm, so that the person can hear calls from rescue personnel, etc. Should the person lose consciousness, the switch will be released, allowing the alarm to again sound, helping to guide rescue personnel to the person.

In the event of a disaster such as an earthquake or tornado, trapping a person in a room or other area, the alarm can be manually activated, alerting rescue personal to the person's location. Further, the device can also be used as a normal flashlight.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
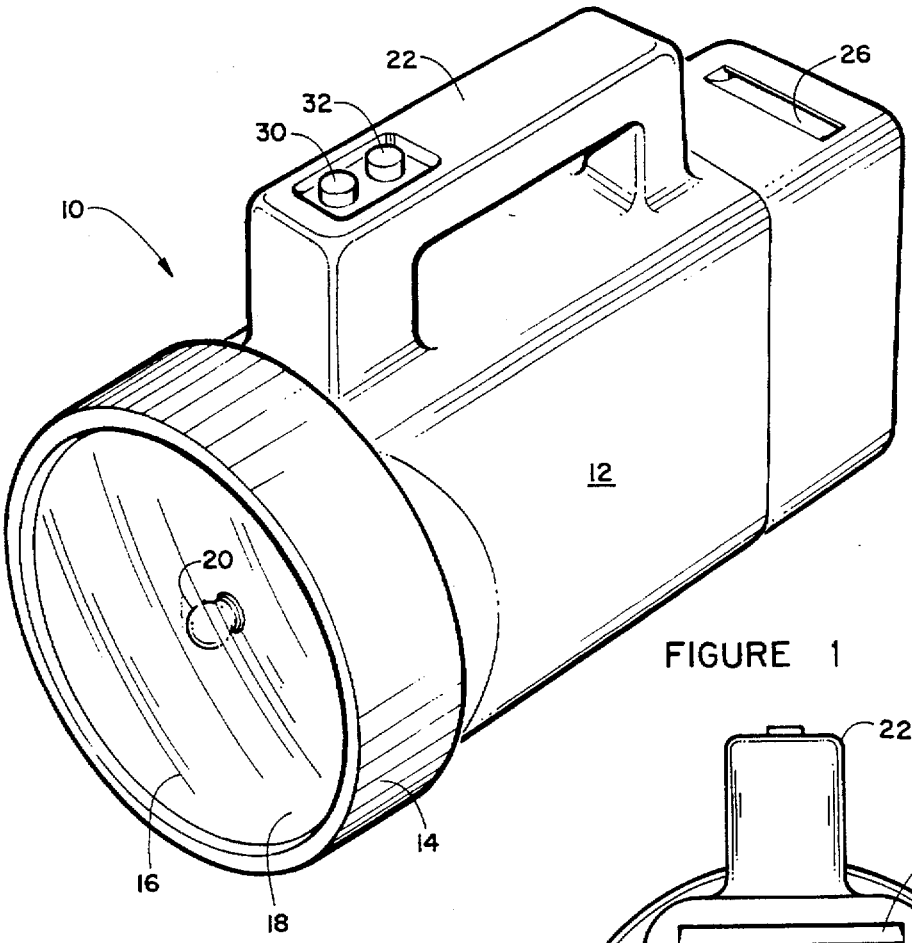
FIG. 1 is a perspective view of the combination flashlight, smoke detector and emergency alarm assembly of this invention.

Referring to FIGS. 1, there is seen a perspective view of the combination flashlight, smoke detector and emergency alarm assembly 10 all contained in a housing 12. Housing 12 may be formed from any suitable material, such as high strength plastics, preferably of a bright, easily seen color such as red or yellow. Batteries and other components are housed in the central portion of housing 12.

A removable cover 14 is provided at one end of housing 12 to provide access to the interior. A transparent plastic, typically acrylic or polycarbonate, window 16 covers the end of cover 14. A reflector 18 is positioned behind window 16 for directing light from a bulb 20 mounted at the center of reflector 18 out through window 16. A handle 22 is mounted along the top of housing 12 to permit the unit to be easily carried with the light projecting ahead. A smoke detection system and alarm (not seen, shown in FIG. 3) are contained within housing 12. Vents 26 in the form of plural slots are formed in housing 12 (as seen in FIGS. 1 and 2) adjacent to the gas detector (not seen) within the housing to permit gasses to enter the smoke detection system and allow egress of sound from the alarm.

Figure 2:
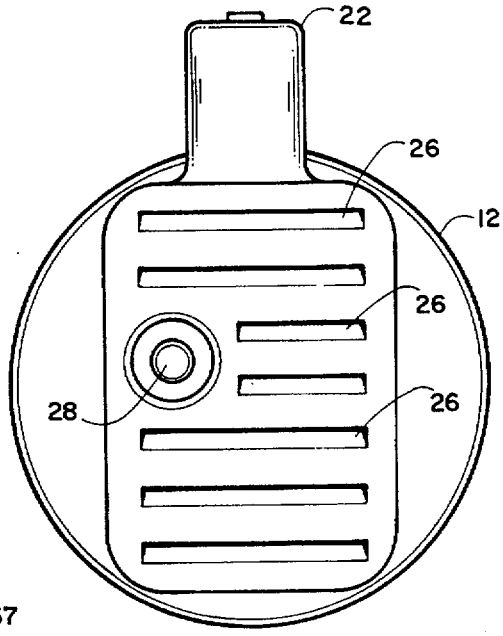
FIG. 2 is a rear elevation view of the assembly.

As seen in FIG. 2, push-button switch 28 is provided to test the alarm and to turn on the alarm alone in an emergency system, such as where the person is trapped in a room or area by a jammed door, fallen debris, etc.

As shown in FIG. 1, a flashlight on-off switch 30 is provided so that the flashlight can be turned on or off. A pushbutton, momentary, switch 32 is provided to turn the alarm off when it is sounding due to the presence of smoke, so that the person can hear emergency personnel while exiting a fire area. Switch 32 acts as a "dead man" switch, since falling, losing consciousness, etc. will cause his or her finger to move away from the switch, allowing the alarm to resume sounding.

If desired, an additional switch could be provided to turn the smoke detection system on and off. However, this is generally undesirable, since the smoke detector ordinarily should be left on at all times. For storage, shipping, etc. of the assembly, the batteries would simply be removed to inactivate the smoke alarm.

Figure 3:
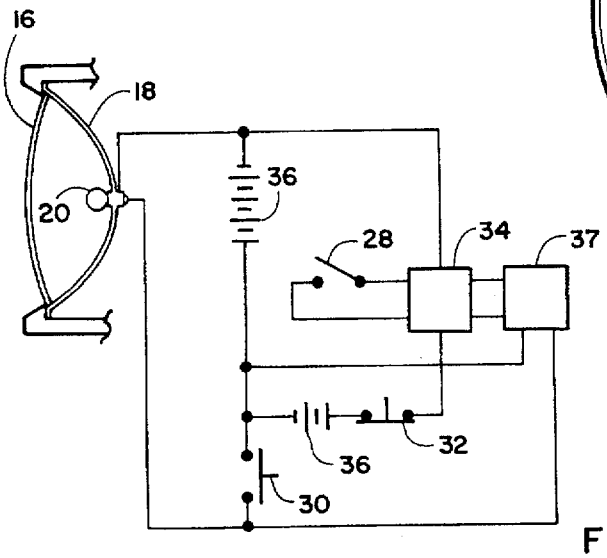
FIG. 3 is a schematic circuit diagram of the electrical circuit of the assembly shown in FIG. 1.

FIG. 3 shows a schematic circuit diagram for the assembly. A conventional smoke detector 34, which includes an audible alarm, is powered by a battery array 36, typically six 1.5 volt "C" cells in series. In the normal manner, when detector 32 detects products of combustion i.e. visible or invisible "smoke", the alarm will sound. When the alarm is activated, flashlight bulb 20 (typically a 4.8 or 6 v. krypton bulb, part 4700 from Lumilite) will automatically be turned on via relay 36, typically a Deltrol No. 425 IC from Delco Electronics. Flashlight bulb 20 is powered by four of the six batteries in array 36.

When the alarm sounds and the person exists the area which may be dark or smoke-filled, the flashlight will guide the way. The alarm can be turned off by spring loaded, normally closed, push-button switch so that the person can hear rescue personnel. Should the person fall, lose consciousness etc. and release switch 38, the alarm will again sound to aid rescue personnel in finding him or her.

If the person is trapped in an area, due to a jammed door, earthquake, etc., and there is insufficient smoke to activate the alarm, the person may close switch 28, typically a toggle or slide switch to turn on the alarm to find him or her.

If the person is not trapped, and there is insufficient smoke to activate the alarm, but the area is dark, the person may turn on bulb 20 via switch 30, typically a double throw push button switch.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A combination flashlight, smoke detector and emergency alarm assembly which comprises:

a housing;

illumination means at one surface of said housing comprising a flashlight bulb and reflector means for illuminating an area adjacent to said assembly;

a smoke detection system in said housing for detecting the presence of products of combustion;

an audible alarm means in said housing;

a battery means in said housing for powering said smoke detection system, alarm and flashlight bulb;

automatic switch means for turning said alarm on when the level of combustion products at said detection system exceeds a predetermined threshold;

a relay energized by said automatic switch means to automatically turn said flashlight bulb on when said automatic switch means is activated;

handle means extending from said housing for use in carrying said combination; and a manually engagable, momentary, normally closed, switch on said handle, said manually engagable switch in series with said automatic switch means to disable said alarm while said switch is manually engaged;

whereby a person in a fire situation will be alerted by said alarm and can hold said momentary switch open to turn the alarm off during escape, with the alarm automatically reactivated should said momentary switch be released.

2. A combination flashlight, smoke detector and emergency alarm assembly according to claim 1 further including an independent manual switch for turning said flashlight on and off while said automatic switch means is off.

3. A combination flashlight, smoke detector and emergency alarm assembly according to claim 1 further including a manual switch to turn said alarm on while said automatic switch is not activated.

4. A combination flashlight, smoke detector and emergency alarm according to claim 3 wherein said higher voltage is 9 volts and said lower voltage is 6 volts.

5. A combination flashlight, smoke detector and emergency alarm assembly according to claim 1 wherein said battery means is a single, centrally located, assembly of battery cells which provides a relatively higher voltage to said smoke detector and includes a tap to provide a relatively lower voltage to said flashlight.

6. A combination flashlight, smoke detector and emergency alarm assembly according to claim 5 wherein said higher voltage is 9 volts and said lower voltage is 6 volts.

7. A combination flashlight, smoke detector and emergency alarm which comprises:

a flashlight comprising a flashlight bulb and reflector means for illuminating an area adjacent to said flashlight;

a smoke detection system for detecting the presence of products of combustion;

an audible alarm;

a battery means for powering said smoke detection system, alarm and flashlight bulb;

automatic switch means for turning said alarm on when the level of combustion products at said detection system exceeds a predetermined threshold;

a relay actuated by said automatic switch means to turn said flashlight bulb when said automatic switch means is activated; manual switch means for turning said flashlight bulb on and off while said automatic switch is off;

a manual switch to turn said alarm on while said automatic switch is not activated; and a manually engagable momentary, normally closed, switch in series with said automatic switch means to disable said alarm while said momentary switch is manually engaged.

8. A combination flashlight, smoke detector and emergency alarm according to claim 7 wherein said battery means provides a relatively higher voltage to said smoke detector and includes a tap to provide a relatively lower voltage to said flashlight.

* * * * *